United States Patent [19]

Lonati

[11] 4,099,392

[45] Jul. 11, 1978

[54] YARN CUTTING AND GRIPPING DEVICE FOR A CIRCULAR KNITTING MACHINE

[76] Inventor: Francesco Lonati, Via Valsorda, 28, Brescia, Italy

[21] Appl. No.: 802,096

[22] Filed: May 31, 1977

[30] Foreign Application Priority Data

Jun. 21, 1976 [IT] Italy ..... 24512 A/76
Nov. 18, 1976 [IT] Italy ..... 29510 A/76

[51] Int. Cl.[2] ..... D04B 15/60

[52] U.S. Cl. ..... 66/140 R; 66/145 R; 66/14

[58] Field of Search ..... 66/145 R, 140 R, 142, 66/14

[56] References Cited

U.S. PATENT DOCUMENTS

| | | | |
|---|---|---|---|
| 3,246,489 | 4/1966 | Della Bella | 66/145 R |
| 3,379,036 | 4/1968 | Farmer | 66/145 R |
| 3,640,094 | 2/1972 | Piana et al. | 66/142 X |
| 3,803,878 | 4/1974 | Lonati | 66/140 R |

*Primary Examiner*—Louis K. Rimrodt
*Assistant Examiner*—Andrew M. Falik
*Attorney, Agent, or Firm*—Guido Modiano; Albert Josif

[57] ABSTRACT

There is disclosed a yarn cutting and gripping device of the type including a plurality of strip-like elements lengthwise movable adjacent a fixed blade and having a hooked end for cutting the yarn in cooperation with the fixed blade. The strip-like elements are resiliently urged against the fixed blade by a block arranged at the side of the strip-like elements opposite to the fixed blade. Each element has a lug extending below the hooked end substantially parallel thereto and recessed with respect to the cutting plane so as to seize the yarn and cause it to form a loop about this lug before and after being cut by the hooked end, thus increasing the retaining force of the cut yarn. The strip-like elements may be formed by two parallel parts, the one having the hooked end and the other the projecting lug.

10 Claims, 11 Drawing Figures

16
2b
14
2c
10
11
12
16
2
3
13
1a 16
2b
14
2c
10
11
14
12
16
2
3
13
1a 2c
2b
2b
2c
VI
2c
VI
2
2a
2
2a 15
14
7
8
3
4
1a
9
2
2
2
2a
2a
2a
2a
5
5
6
1

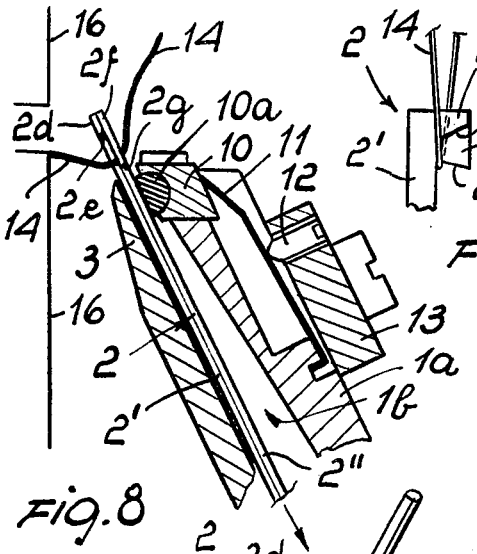
Fig. 8
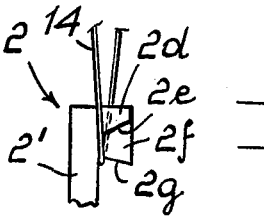
Fig. 8a
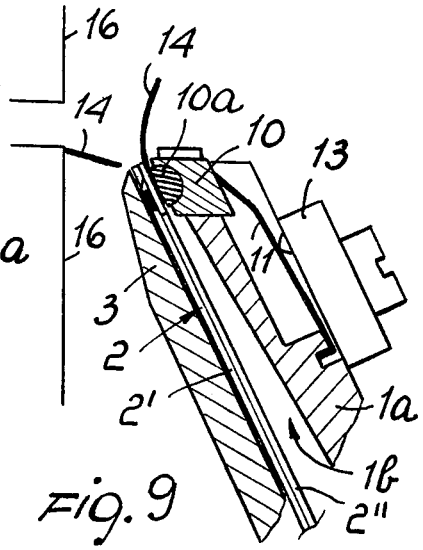
Fig. 9
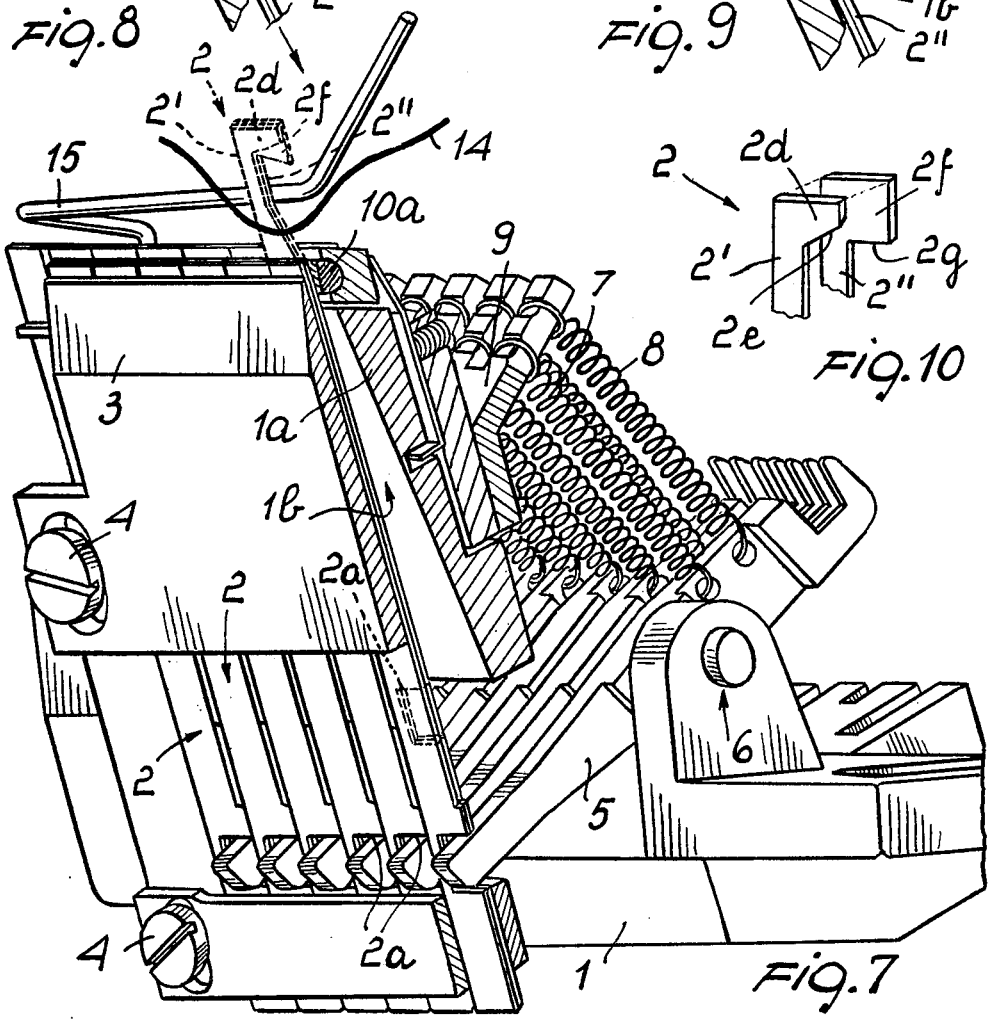
Fig. 7
Fig. 10

YARN CUTTING AND GRIPPING DEVICE FOR A CIRCULAR KNITTING MACHINE

BACKGROUND OF THE INVENTION

This invention relates to a yarn cutting and gripping device for use on a circular knitting machine, in particular a double-cylinder one, the device being of the type comprising several adjacent strip-like elements which are movable back-and-forth along their lengths, adjacently a fixed blade and provided each with a hooked end lying on the plane of the strip-like elements, the hooked end having a cutting edge adapted to cooperate with the fixed blade to perform the cutting of the yarn, the strip-like elements being pressed against the fixed blade by an elastically urged body located on the opposite side to the fixed blade, said body acting as a gripping means of the yarn cut by the device.

A device to this general design is disclosed in U.S. Pat. No. 3,803,878 to Francesco Lonati. In this device, the strip-like elements are movable along a direction which is inclined to the cylinder(s) of the machine in a supporting structure attached to one side of the cylinder(s) at the yarn feed area. Each strip-like element is operable independently of the others through a respective lever controlled by the machine program.

When a yarn being processed is to be cut, for replacement with another yarn, for instance of a different color or count, the hooked end is caused to seize the yarn to be cut and moved down to contact the fixed blade, thus effecting the yarn cutting operation on one side and yarn gripping operation on the opposite side, where the yarn is retained between the strip-like element and the gripping body.

The gripping body may advantageously be a block of a resiliently yielding material, e.g. of a plastic material such as the one known in the trade as nylon, thereby the retention of the cut yarn is improved.

A device of this type has proved capable of providing a quick and accurate cutting operation, along with an effective gripping action.

However, it has been found that in some conditions, for some types of yarn, and especially in the case of a simultaneous retention of two yarns having different counts, the retaining action may be inadequate. This particularly when an excessive tension is applied to the yarn between the feeding reel and gripping unit.

SUMMARY OF THE INVENTION

It is a primary object of this invention to improve upon the device described above, by increasing the effectiveness thereof in retaining the yarn.

Another object of the invention is to provide such an improvement with simple means of limited cost, said means being such that the application of the inventive device to a machine already equipped with a prior art device only requires the replacement of a minor number of parts, and not the replacement of the device as a whole.

These and other objects, such as will appear hereinafter, are achieved by a yarn cutting and gripping device for a circular knitting machine, and particularly for a doublecylinder circular knitting machine, said device comprising a fixed blade, a plurality of adjacent strip-like elements, movable back-and-forth along the length thereof adjacently said fixed blade and each having a hooked end lying on the same plane as said strip-like elements, said hooked end having a cutting edge adapted to cooperate with said fixed blade to effect the cutting of the yarn, an elastically biased body arranged on the opposite side to said fixed blade for pressing said strip-like elements against said fixed blade, said body acting as a gripping means for the yarn cut by the device, wherein each of said strip-like elements has, between said hooked end and remaining portion thereof, a lug spaced apart from said hooked end and extending substantially parallel thereto, the surface of said lug facing said fixed blade being recessed with respect to the plane of cutting by an extent substantially corresponding to the transverse dimension of the yarn to be cut and gripped.

In a device of this type, the yarn is no longer seized by the hooked end, but rather by the underlying lug which entrains it through the space between the fixed blade and gripping body, causing the yarn to form a loop around said lug, said loop being maintained even after the cut performed by the hooked end. This loop advantageously increases the resistance to any release of the yarn from the gripping body, while the recess in the lug may constitute a further stop point, the end of the cut yarn being accomodated between the fixed blade and the recessed surface of the lug. This results in a more effective retention of the yarn, even in the case of two adjacent yarns having different transverse dimensions, since the retaining action resulting from the loop formation is applied indifferently and independently at every yarn.

According to a further development of the invention, the strip-like elements comprise each two strip-like parts, arranged side-by-side and concurrently movable parallel to each other, said hooked end being formed on the part adjacent said fixed blade, and said lug on the part adjacent said yarn gripping body.

With such an embodiment providing two discrete parts, one whereof is exclusively devoted to the cutting of the yarn(s), while the other, being recessed by an extent corresponding to the thickness of the cutting strip-like part, exclusively serves to entrain and retain the yarn(s), it becomes possible to design the active portions of the strip-like elements with a greater degree of freedom, shaping them in a most suitable style for the functions they are called upon to perform. Thus, it is possible to make the lower corner of the lug inclined or sloped with respect to the stem of the strip-like part, namely such as to include an angle of less than 90° with the corner of said stem, this being effective to push the gripped yarn toward the stem of the cutting strip-like part. Such an effect is specially advantageous in the case of two yarns having different sizes, since it favors their overlapping, thus increasing considerably the retention of the thinner yarn which is united with the thicker one. Moreover, it is possible to implement the lug in a continuous manner from the upper end of its respective strip-like part to the lower yarn retaining corner, that is to provide a continuous surface facing the gripping body, thus increasing the yarn gripping surface area, on one side, and avoiding deformation of the yielding gripping body, on the other side, as due to breaks in the surface, which breaks are necessary in the first embodiment for sharpening reasons. Another advantage of this invention is indeed the ease wherewith the cutting edge of the cutting strip-like part is sharpened, because since this part is separable from the one entraining and retaining the yarn, it may be sharpened with the usual sharpening tools.

BRIEF DESCRIPTION OF THE DRAWINGS

Further features and advantages of the invention will be more apparent from the following detailed description of two preferred, though not restrictively, embodiments of the invention, discussed by way of example and illustrated in the accompanying drawings, where:

FIG. 7 is a perspective view of a device incorporating strip-like elements configurated in conformity with another embodiment of the invention;

FIG. 8 is a fragmentary sectional view through the device of FIG. 7, showing one of the strip-like elements at a yarn gripping stage;

FIG. 8*a* is a view, tilted through 90°, of the strip-like element of FIG. 8;

FIG. 9 is a sectional view similar to FIG. 8, but showing the strip-like element at a stage just after the cutting stage; and FIG. 10 is a detail perspective view of a further embodiment of the strip-like element of FIGS. 7–9, the two component parts being shown separate for clarity.

DESCRIPTION OF THE PREFERRED EMBODIMENTS

Figures 1, 2, 3, 4, 5, 6:
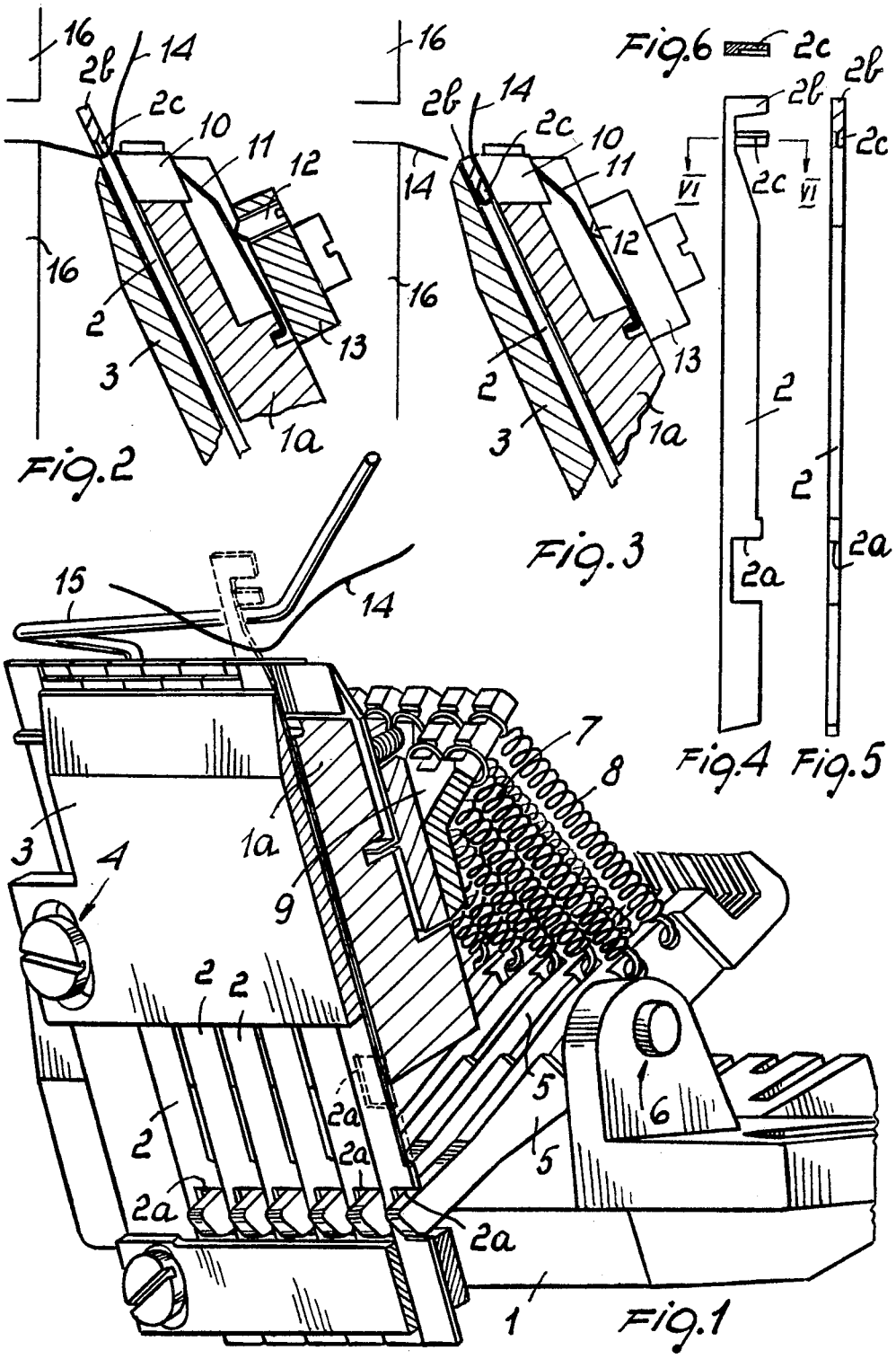
FIG. 1 is a perspective view of a device according to the invention, showing in dotted lines one of the strip-like elements, according to a first embodiment, at a position just prior to the yarn gripping.
FIG. 2 is a partly sectional view through the device of FIG. 1, with one of the strip-like elements shown at a yarn gripping stage.
FIG. 3 is a sectional view similar to FIG. 2, but showing the strip-like element at the stage immediately following the yarn cutting.
FIG. 4 is a side view of the strip-like element of the preceding figures.
FIG. 5 is a front view of that same element.
FIG. 6 is a sectional view taken through the strip-like element along the line VI—VI of FIG. 4.

The device according to this invention is basically constructed similar to the one disclosed in the cited U.S. Pat. No. 3,803,878. It comprises essentially a supporting structure 1, 1*a*, attached to the stationary frame of the machine close to the cylinder(s) thereof. In the part 1*a*, there are slidable a number of adjacent strip-like elements 2, cooperating with a fixed blade 3, affixed to the structure 1*a* at 4. The strip-like elements 2 slide along their lengths. They are each controlled by a respective actuating lever 5, pivotally mounted at 6 to the structure 1 and having one end in engagement with a notch 2*a* in the respective element 2 and the other end in engagement with actuating means, not shown, under control by the machine program. The levers 5 are normally held inoperative, such as in the position shown in FIG. 1, by springs 7,8 stretched between respective levers 5 and a support 9 attached to the structure 1*a*. In this position, the strip-like elements 2 are inside the structure 1*a*.

The numeral 10 denotes the gripping body associated with each of the elements 2 opposite the fixed blade 3. Each body 10 is resiliently or elastically urged by a reed spring 11 pressing it against a respective element 2. The body 10 may advantageously be a block of a resiliently yielding material such as nylon or the like. The compressive force may be adjusted through an adjusting screw 12 threadably engageable in a body 13 attached to the structure 1*a*.

Each strip-like element 2 is provided with a hooked end 2*b* extending on the same plane as the element, substantially perpendicularly to the longitudinal extension thereof, and adapted to cooperate with the fixed blade 3 in cutting the yarn 14. To this aim, the end 2*b* has a cross-section preferably configurated as a rectangular trapezium, where the apex defined by the major base and oblique side generates the cutting edge, as may be observed in FIGS. 2, 3, and 5.

The hooked end 2*b* has its lower cutting edge preferably not exactly perpendicular to the longitudinal direction of the element 2, but rather inclined such that the end 2*b* has a greater height at the attachment area to the body of the element 2. This configuration favors the cutting action and ensures that the hooked end 2*b* is never blocked by the upper edge of the fixed blade 3 during the withdrawal stage of the element 2. Obviously, that configuration is not strictly necessary, and the hooked end 2*b* may have a uniform height, as shown for the element 2, in dotted lines in FIG. 1.

The reference numeral 15 denotes a yarn guiding member 14 at a stage immediately preceding the cutting of the yarn.

According to the invention, each strip-like element 2 is provided, between the hooked end 2*b* and the remaining portion thereof, with a lug 2*c* spaced apart from the hooked end 2*b* and extending substantially parallel to the end 2*b*. This lug 2*c* has its face towards the fixed blade 3 recessed with respect to the cutting plane, i.e., to an imaginary plane wherealong the hooked end 2*b* surface moves adjacently the fixed blade 3. The extent of this recess substantially matches the transverse dimension of the yarn to be cut. The cross-section of the lug 2*c* is, of preference, substantially configurated as a rectangular trapezium, with its oblique side facing the oblique side of the hooked end 2*b* and lying parallel thereto, as shown best in FIGS. 2, 3, and 5 of the drawings.

The device according to the invention operates as follows.

When a yarn is to be cut and replaced with another yarn, the corresponding lever 5 is actuated to displace the respective element 2 outwards until it reaches the position shown in dotted lines in FIG. 1 (For clarity reasons, the related lever 5 has not been represented in its corresponding position). The rotational movement of the needle cylinders 16 (or, of the needle cylinder in the instance of a single-cylinder machine), as well as the withdrawal of the respective feeding finger to the inoperative position, cause the yarn 14, no longer being knitted by the needles, to be brought to the gripping area of the element 2, below the lug 2*c*.

The lever 5 is then controlled to move back to its rest or inoperative position, causing the respective element 2 to be lowered. Initially, as shown in FIG. 2, the yarn 14 gripped by the lug 2*c* is inserted through the space between the fixed blade 3 and the gripping body 10, without being cut as yet, since the withdrawn lug 2*c* is separated from the fixed blade 3 by an amount substantially corresponding to the diameter of the yarn 14, thereby no cutting action may take place. The yarn arranges itself to form a loop around the lug 2*c*, while it is being gripped between the body 10 and element 2.

At a further time, as the element 2 moves further down, the yarn is cut by the end 2*b* in cooperation with the fixed blade 3, while it still remains with its loop around the lug 2*c* (FIG. 3). This loop arrangement considerably increases the yarn retention, since a considerable frictional resistance is produced between the yarn and the lug 2c in the event of a tension being applied on the yarn, said resistance adding to the retention action exerted on the yarn by the body 10. Thus, even if the yarn may be inadequately retained between the body 10 and element 2, the resistance created in the yarn bent around the lug 2c contributes to the reliability of the yarn retention.

It will appear how even in the case of two yarns having different transverse dimensions, but being cut and gripped concurrently, any possible retention failure which may affect the yarn having the smaller transverse dimension between the body 10 and element 2 owing to the presence of the larger transverse dimension yarn would be advantageously obviated by the resisting action otherwise generated between the smaller transverse dimension yarn and the lug 2c, by virtue of the loop arrangement of the latter yarn.

It has been mentioned above that the depth of the recess in the lug 2c with respect to the cutting plane is substantially equal to the transverse dimension of the yarn to be cut. This is intended to include, within limits, the existence of differences between said measurement and the yarn transverse dimension. Should the depth of the recess be less than the yarn transverse dimension, then a further retention of the yarn would also be provided between the recessed surface of the lug 2c and the fixed blade 3; however, the problem could arise, when such a measurement is excessively smaller, of an unsatisfactory cutting action by the cutting edge of the end 2b, which would be too far apart from the fixed blade 3. In the event of the recess measurement being greater than the yarn transverse dimension, then this further retaining action would be missing between the recessed surface of the lug 2c and the fixed blade 3, without, however, affecting to any appreciable extent the overall retaining action, so long as the difference between the recess measurement and transverse dimension of the yarn does not exceed a certain limit.

According to the embodiment of the invention shown in FIGS. 7 to 10, each strip-like element 2 comprises two strip-like parts 2' and 2'', respectively, which are arranged side by side and concurrently movable parallel to each other. To this aim, they are provided, preferably each of them, with a recess or notch 2a for engagement with one and the same actuating lever 5.

The two strip-like parts are preferably configurated to have the same shape throughout their height, with the sole exception of their end top portions. There, the strip-like part 2' adjacent the fixed blade 3 has a hooked end 2d, provided with a cutting edge 2e at its lower portion, said cutting edge being adapted to cooperate with the fixed blade 3 in cutting the yarn. The strip-like part 2'' has instead a lug 2f, preferably extending uninterruptly to a height greater than the height of the hooked end 2d and terminating at the bottom in a corner or edge 2g defining the yarn retaining edge. In the side-by-side operative arrangement of the two strip-like parts 2', 2'', the lower yarn retaining edge 2g is then located at a lower level than the cutting edge 2e, in addition to being recessed from the cutting plane.

The lower yarn retaining edge 2g is of preference so oriented as to include, with the stem of its respective strip-like part 2'', an angle of less than 90°.

The strip-like parts 2', 2'' may have the same thickness. Most suitably, the thickness of the cutting part 2' substantially corresponds to the transverse dimension of the yarn 14 to be cut, thereby, as the two strip-like parts 2', 2'' contact each other, the plane of the lug 2f in the part 2' towards the fixed blade 3 is recessed from the cutting plane by an amount substantially equal to the transverse dimension of the yarn 14.

According to a further and specially advantageous embodiment, the gripping body 10 may include, on its side facing the strip-like element 2, an insert 10a of a soft yielding material having a high frictional coefficient, such as rubber or a rubber-like material known in the trade under the denomination "Vulkollan", which possesses elastic properties similar to rubber but is more resisting to wear and tear as well as to abrasion. The insert 10a projects from the gripping body 10, thus constituting an effective means of yarn retention. Since the lug 2f may be implemented as a continuous surface, to the exclusion of any interruptions, the insert 10a suffers no deterioration by the movements of the strip-like element 2.

Advantageously, the body 1a may be provided with a chute 1b of increasing cross-section from top to bottom for the removal of any hairy matter and yarn deposits which would otherwise hinder the movements of the strip-like elements 2.

In operation, the device of FIGS. 7–10 is substantially similar to the device of FIGS. 1–6. The yarn 14 to be cut, being seized by the lower edge 2g of the lug 2f in the strip-like part 2'', is entrained through the space between the fixed blade 3 and gripping body 10 and then, at a given point of the concurrent descent of the two strip-like parts 2', 2'', is cut by the cutting edge 2e and edge of the fixed blade 3. Most advantageously, the inclination of the lower edge 2g causes the yarn to slide down towards the stem of the strip-like parts 2', 2'' (FIG. 8a), which favors an accurate and neat cut. The free yarn end is retained between the lug 2f and fixed blade 3. Since the inclination of the lower edge 2g forces the yarn in the corner between the edge and the stem of the part 2'', it happens that the yarn is also subjected to a resisting action at the side.

In the instance of two yarns having different sectional dimensions, the inclination of the lower edge 2g advantageously favors an overlapping of the yarns urged to move to the corner, and this results in a strengthened retention.

The invention, as described hereinabove, is susceptible to many modifications and variations, all of which fall within the present inventive concept. Thus, for example, the lower portion of the lug 2c could be rounded off to avoid damaging the yarn against sharp corners. The cross-section of the lug 2c could also be modified to a rectangle rather than a trapezium, with the omission of the oblique side shown in the Figures. The lug 2f could have a lower edge 2g arranged at 90° to the direction of the stem of the part 2'', as shown in FIG. 10. The gripping body 10 could be a single block of a yielding material of the type of that used for the insert 10a. The lower edge 2g could obviously be rounded off across the lug 2f in order not to damage the yarn. Understandably, the shapes of the ends 2d and 2f could also be varied within limits to adjust them for the different requirements posed by different types of yarn. The two parts 2' and 2'' could also be removably connected to each other, and one of them only be provided with a driving recess 2a. Obviously, the number of the strip-like elements 2 may be any one.

I claim:

1. A yarn cutting and gripping device for a circular knitting machine, and particularly for a double-cylinder circular knitting machine, said device comprising a fixed blade, a plurality of adjacent strip-like elements, movable back-and-forth along the length thereof adjacently said fixed blade and each having a hooked end lying on the same plane as said strip-like elements, said hooked end having a cutting edge adapted to cooperate with said fixed blade to effect the cutting of the yarn, an elastically biassed body arranged on the opposite side to said fixed blade for pressing said strip-like elements against said fixed blade, said body acting as a gripping means for the yarn cut by the device, wherein each of said strip-like elements has, between said hooked end and remaining portion thereof, a lug spaced apart from said hooked end and extending substantially parallel thereto, the surface of said lug facing said fixed blade being recessed with respect to the plane of cutting by an extent substantially corresponding to the transverse dimension of the yarn to be cut and gripped.

2. A device according to claim 1, wherein said lug has a cross-section the lower portion whereof being intended to contact the yarn has a rounded shape.

3. A device according to claim 1, wherein said hooked end has a cutting edge extending along a non-perpendicular direction with respect to the longitudinal direction of the corresponding strip-like element, the height of said end being greater at the connecting point of said end to the body of said strip-like element.

4. A device according to claim 1, wherein said hooked end and said lug have each a cross-sectional configuration substantially rectangular trapezium-like, the oblique sides of the rectangular trapezia facing each other and being parallel to each other.

5. A device according to claim 1, wherein said strip-like elements comprise each two strip-like parts arranged side by side and concurrently movable parallel to each other, said hooked end being formed on the part adjacent said fixed blade and said lug on the part adjacent said yarn gripping body.

6. A device according to claim 5, wherein said lug has a lower yarn retaining edge including with the stem of the strip-like part an angle of less than 90°

7. A device according to claim 5, wherein said lug has, at least on the side thereof facing said yarn gripping body, a continuous flat surface free from interruptions throughout the extension thereof.

8. A device according to claim 7, wherein said yarn gripping body has on the side thereof facing said strip-like elements an insert of a soft yielding material possessing a high frictional coefficient, said insert projecting from said yarn gripping body.

9. A device according to claim 5, wherein said two strip-like parts are each provided with a recess for engagement with one and the same actuating lever of said strip-like elements.

10. A device according to claim 1, further comprising a body supporting said strip-like elements, said supporting body having a chute growing wider towards its bottom at said strip-like elements for the removal of yarn deposits.

* * * * *